US008241558B2

(12) United States Patent
Hayashi et al.

(10) Patent No.: US 8,241,558 B2
(45) Date of Patent: Aug. 14, 2012

(54) HIGH-CR, HIGH-NI, HEAT-RESISTANT, AUSTENITIC CAST STEEL AND EXHAUST EQUIPMENT MEMBERS FORMED THEREBY

(75) Inventors: Keijiro Hayashi, Tochigi-ken (JP); Kenji Itoh, Saitama-ken (JP); Akinaga Odaira, Tochigi-ken (JP); Koki Otsuka, Tochigi-ken (JP)

(73) Assignee: Hitachi Metals, Ltd., Tokyo (JP)

( * ) Notice: Subject to any disclaimer, the term of this patent is extended or adjusted under 35 U.S.C. 154(b) by 573 days.

(21) Appl. No.: 11/568,076

(22) PCT Filed: Apr. 19, 2005

(86) PCT No.: PCT/JP2005/007483

§ 371 (c)(1),
(2), (4) Date: Oct. 19, 2006

(87) PCT Pub. No.: WO2005/103314

PCT Pub. Date: Nov. 3, 2005

(65) Prior Publication Data

US 2007/0217941 A1 Sep. 20, 2007

(30) Foreign Application Priority Data

Apr. 19, 2004 (JP) ..... 2004-123562

(51) Int. Cl.
*C22C 38/22* (2006.01)

(52) U.S. Cl. ..... 420/38; 420/42

(58) Field of Classification Search ..... 420/38, 420/42

See application file for complete search history.

(56) References Cited

U.S. PATENT DOCUMENTS

| | | | | |
|---|---|---|---|---|
| 4,363,660 | A * | 12/1982 | Wakita et al. | 420/12 |
| 5,489,416 | A * | 2/1996 | Takahashi et al. | 420/40 |
| 5,501,835 | A | 3/1996 | Watanabe et al. | |
| 6,685,881 | B2 * | 2/2004 | Hamano et al. | 420/42 |
| 2002/0061257 | A1 | 5/2002 | Hamano et al. | |
| 2002/0102178 | A1 | 8/2002 | Hiramatsu et al. | |
| 2002/0110476 | A1 | 8/2002 | Maziasz et al. | |
| 2003/0056860 | A1 | 3/2003 | Maziasz et al. | |
| 2003/0084967 | A1 | 5/2003 | Maziasz et al. | |

FOREIGN PATENT DOCUMENTS

| | | | |
|---|---|---|---|
| EP | 0 613 960 | A1 | 9/1994 |
| EP | 0 668 367 | A1 | 8/1995 |
| EP | 1 191 117 | A2 | 3/2002 |
| EP | 1 215 298 | A2 | 6/2002 |

(Continued)

OTHER PUBLICATIONS

Translation of Japanese Office Action dated Jan. 5, 2011 in JP application 2006-512553.

(Continued)

*Primary Examiner* — Jie Yang
(74) *Attorney, Agent, or Firm* — Sughrue Mion, PLLC

(57) ABSTRACT

A high-Cr, high-Ni, heat-resistant, austenitic cast steel comprises as main components C, Si, Mn, Cr, Ni, W and/or Mo, and Nb, the balance being substantially Fe and inevitable impurities, N being 0.01-0.5%, Al being 0.23% or less, and O being 0.07% or less by weight. Exhaust equipment members are produced by using this high-Cr, high-Ni, heat-resistant, austenitic cast steel.

7 Claims, 4 Drawing Sheets

FOREIGN PATENT DOCUMENTS

| | | | | |
|---|---|---|---|---|
| EP | 1 219 720 | A2 | | 7/2002 |
| JP | 48-102716 | | | 12/1973 |
| JP | 51-8807 | B2 | | 3/1976 |
| JP | 55152158 | | | 11/1980 |
| JP | 61177352 | | | 8/1986 |
| JP | 05005161 | A | * | 1/1993 |
| JP | 6-212366 | A | | 8/1994 |
| JP | 7-90502 | A | | 4/1995 |
| JP | 7-228950 | A | | 8/1995 |
| JP | 7-278759 | A | | 10/1995 |
| JP | 08-120413 | | | 5/1996 |
| JP | 10001753 | | | 1/1998 |
| JP | 2760004 | B2 | | 5/1998 |
| JP | 11-293412 | A | | 10/1999 |
| JP | 11335790 | | | 12/1999 |
| JP | 2000-291430 | A | | 10/2000 |
| JP | 2002-167655 | A | | 6/2002 |
| JP | 200219451 | | | 7/2002 |
| JP | 2002-309935 | A | | 10/2002 |
| JP | 2003049658 | | | 2/2003 |
| JP | 2003-166038 | | | 6/2003 |

OTHER PUBLICATIONS

Notification of Reasons of Refusal issued in Application No. 2006-512553 dated Apr. 27, 2011.

* cited by examiner

HIGH-CR, HIGH-NI, HEAT-RESISTANT, AUSTENITIC CAST STEEL AND EXHAUST EQUIPMENT MEMBERS FORMED THEREBY

FIELD OF THE INVENTION

The present invention relates to a high-Cr, high-Ni, heat-resistant, austenitic cast steel having excellent thermal fatigue life at 1000° C. or higher, and an exhaust equipment member formed thereby for automobile engines, etc.

BACKGROUND OF THE INVENTION

Conventional exhaust equipment members such as exhaust manifolds, turbine housings, etc. for automobile engines are made of heat-resistant cast iron such as Niresist cast iron (Ni—Cr—Cu-based, austenitic cast iron), heat-resistant, ferritic cast steel, etc. However, although the Niresist cast iron exhibits relatively high strength at an exhaust gas temperature up to 900° C., it has reduced oxidation resistance and thermal cracking resistance at temperatures exceeding 900° C., exhibiting poor heat resistance and durability. The heat-resistant, ferritic cast steel is utterly poor in strength at an exhaust gas temperature of 950° C. or higher.

Under such circumstances, JP2000-291430A proposes a thin exhaust equipment member formed by high-Cr, high-Ni, heat-resistant, austenitic cast steel, which is disposed at the outlet of an engine to improve the initial performance of an exhaust-gas-cleaning catalyst, at least part of paths brought into contact with an exhaust gas being as thin as 5 mm or less. Its weight loss by oxidation is 50 mg/cm$^2$ or less when kept at 1010° C. for 200 hours in the air, 100 mg/cm$^2$ or less when kept at 1050° C. for 200 hours in the air, and 200 mg/cm$^2$ or less when kept at 1100° C. for 200 hours in the air. Its thermal fatigue life is 200 cycles or more when measured by a thermal fatigue test comprising heating and cooling at the heating temperature upper limit of 1000° C., a temperature amplitude of 800° C. or more, and a constraint ratio of 0.25, and 100 cycles or more when measured by a thermal fatigue test comprising heating and cooling at the heating temperature upper limit of 1000° C., a temperature amplitude of 800° C. or more, and a constraint ratio of 0.5. Accordingly, this exhaust equipment member has excellent durability when exposed to an exhaust gas at temperatures exceeding 1000° C., particularly around 1050° C., further around 1100° C.

The high-Cr, high-Ni, heat-resistant, austenitic cast steel forming the exhaust equipment member of JP2000-291430A has a composition comprising by mass 0.2-1.0% of C, 2% or less of Si, 2% or less of Mn, 0.04% or less of P, 0.05-0.25% of S, 20-30% of Cr, and 16-30% of Ni, the balance being Fe and inevitable impurities, which may further contain 1-4% of W and/or more than 1% and 4% or less of Nb.

From the aspect of environmental protection, automobile engines are recently required to have higher performance, increased fuel efficiency, and reduced exhaust gas emission. For this purpose, higher-power, higher-combustion-temperature engines are developed, elevating exhaust gas temperatures. Accordingly, exhaust equipment members are repeatedly heated and cooled in higher temperature regions than conventional ones. In addition, because they are directly exposed to a high-temperature exhaust gas from engines, they come to be used in severer oxidation environment.

When the exhaust equipment member is exposed to a high-temperature exhaust gas containing oxides such as sulfur oxide, nitrogen oxide, etc., or to the air when heated to high temperatures, an oxide layer is formed on its surface. The thermal expansion difference between the oxide layer and the equipment member matrix, etc. cause microcracks to generate from the oxide layer, through which an exhaust gas intrudes into the equipment member, resulting in further oxidation and cracking. The repetition of oxidation and cracking causes further cracking, resulting in cracks penetrating into the equipment member. The oxide layer peeling from the equipment member may contaminate a catalyst, etc., and cause the breakage and trouble of turbine blades in a turbocharger, etc. Accordingly, the exhaust equipment members exposed to a high-temperature exhaust gas containing oxides are required to have high oxidation resistance.

For higher power and higher-temperature combustion, the so-called direct-injection engine with a combustion chamber, into which gasoline is directly injected, has become widely used for automobiles. Because gasoline is introduced from a fuel tank directly into combustion chamber in the direct-injection engine, only a small amount of gasoline leaks even in the collision of the automobile, making large accident unlikely. Accordingly, instead of disposing exhaust equipment members such as an exhaust manifold, a turbine housing, etc. forward, and intake parts such as an intake manifold, a collector, etc. rearward, intake parts are conventionally disposed in front of an engine to introduce a cold air into a combustion chamber, while exhaust equipment members directly connected to an exhaust-gas-cleaning apparatus are disposed on the rear side of an engine to quickly heat and activate the exhaust-gas-cleaning catalyst at the start of the engine. However, because the exhaust equipment members disposed on the rear side of the engine are unlikely subjected to air flow during driving, resulting in higher surface temperature, they are required to have improved heat resistance and durability at high temperatures.

From the aspect of environmental protection, the exhaust-gas-cleaning catalyst should be heated and activated at the start of the engine. Accordingly, the temperature decrease of the exhaust gas passing through the exhaust equipment members should be suppressed. To suppress the exhaust gas temperature from decreasing (to avoid heat from being removed from the exhaust gas), the exhaust equipment members should have as small heat mass as possible, so that they should be thin. However, because thinner exhaust equipment members are more likely subjected to temperature elevation by the exhaust gas, they should have excellent heat resistance and durability at high temperatures.

Thus, the exhaust equipment members for automobile engines should cope with higher temperatures, severer operation conditions, etc., for instance, exhaust gas temperature elevation and oxidation, surface temperature elevation caused by disposing them rearward, temperature elevation caused by making them thinner. Specifically, the exhaust equipment members are likely to be exposed to a high-temperature exhaust gas at 1000-1150° C., and the exhaust equipment members per se exposed to such high-temperature exhaust gas are heated to 950-1100° C. Accordingly, the exhaust equipment members are required to have high heat resistance and durability and a long life at such high temperatures. To meet this demand, materials forming the exhaust equipment members should also have excellent high-temperature strength, oxidation resistance, ductility, thermal cracking resistance, etc.

With respect to the high-temperature strength, the exhaust equipment members should have not only high high-temperature tensile strength, but also high high-temperature yield strength, strength for suppressing thermal deformation (plastic deformation by compression) against compression stress generated under constrained conditions at high temperatures.

Accordingly, the high-temperature strength is represented by high-temperature yield strength and high temperature tensile strength.

With respect to the oxidation resistance, it is necessary to suppress the formation of oxide layers acting as the starting points of cracking even when exposed to a high-temperature exhaust gas containing oxides. The oxidation resistance is represented by weight loss by oxidation. The exhaust equipment members are cooled from high temperatures to an ambient temperature by the stop of engines, and during the cooling process, compression stress generated at high temperatures is turned to tensile stress. Because the tensile stress during the cooling process causes cracking and breakage, the exhaust equipment members should have such ductility as to suppress the generation of cracking and breakage at room temperature. Accordingly, the ductility is represented by room-temperature elongation.

Thermal cracking resistance is a parameter for expressing these high-temperature strength, oxidation resistance and ductility as a whole. The thermal cracking resistance is represented by a thermal fatigue life [the number of cycles until thermal fatigue fracture occurs by cracking and breakage caused by the repetition of operation (heating) and stop (cooling)].

The exhaust equipment members are subjected to mechanical vibration, shock, etc. during the production process and assembling to engines, at the start of or during the driving of automobiles, etc. The exhaust equipment members are also required to have sufficient room-temperature elongation to prevent cracking and breakage against outside forces generated by these mechanical vibration and shock.

The exhaust equipment member disclosed by JP2000-291430A is particularly excellent in oxidation resistance, but recent demand to higher performance requires further improvement in thermal fatigue life and room-temperature elongation when exposed to an exhaust gas at 1000° C. or higher.

OBJECTS OF THE INVENTION

Accordingly, an object of the present invention is to provide a high-Cr, high-Ni, heat-resistant, austenitic cast steel having high high-temperature yield strength, oxidation resistance and room-temperature elongation, with a particularly excellent thermal fatigue life when exposed to a high-temperature exhaust gas at 1000° C. or higher.

Another object of the present invention is to provide a thin exhaust equipment member having excellent durability when exposed to a high-temperature exhaust gas at 1000° C. or higher, which can be disposed on the rear side of an engine to improve the initial performance of an exhaust-gas-cleaning catalyst.

DISCLOSURE OF THE INVENTION

As a result of intense research to improve the high-temperature properties such as high-temperature yield strength, high-temperature tensile strength, oxidation resistance, thermal fatigue life, etc. and room-temperature elongation of the high-Cr, high-Ni, heat-resistant, austenitic cast steel of JP2000-291430A, the inventors have found that (a) to exhibit improved heat resistance, durability and life when exposed to an exhaust gas at temperatures of 1000° C. or higher, it is important to further improve the high-temperature strength and room-temperature elongation of the cast steel while keeping its oxidation resistance; and that (b) the optimization of the amounts of C, Si, Mn, Cr, Ni, W and/or Mo, and Nb as main components improves high-temperature strength and oxidation resistance; particularly the optimization of the N content while suppressing the Al content improves high-temperature yield strength and room-temperature elongation, thereby providing the high-Cr, high-Ni, heat-resistant, austenitic cast steel with drastically improved thermal fatigue life. The present invention has been completed based on such findings.

Thus, the high-Cr, high-Ni, heat-resistant, austenitic cast steel of the present invention comprises as main components C, Si, Mn, Cr, Ni, W and/or Mo, and Nb, the balance being substantially Fe and inevitable impurities, N being 0.01-0.5%, Al being 0.23% or less, and O being 0.07% or less by weight.

By comprising C, Si, Mn, Cr, Ni, W and/or Mo, and Nb as main components, exhaust equipment members have excellent high-temperature strength and oxidation resistance at exhaust gas temperatures of 1000° C. or higher. With the Al content suppressed to 0.23% or less by weight, the cast steel can be provided with improved high-temperature yield strength without reducing its room-temperature elongation, thereby having sufficient strength to resist compression stress generated when exposed to high temperatures under constraint, and thus suppressing the plastic deformation of exhaust equipment members due to compression. By adjusting the amount of N, an austenite-stabilizing element, to 0.01-0.5% by weight at the same time, the cast steel is provided with improved high-temperature strength, and improved rupture elongation at around room temperature (room-temperature elongation). The improvement of the room-temperature elongation of exhaust equipment members by adding N is extremely effective to suppress their cracking and breakage, which occur by compression stress generated at high temperatures and tensile stress generated during cooling. With such suppression of the Al content and such optimization of the N content, the high-Cr, high-Ni, heat-resistant, austenitic cast steel can be provided with improved high-temperature yield strength and room-temperature elongation, and thus drastically improved thermal fatigue life.

Generally, a melt for cast steel is poured into a mold after deoxidation with a deoxidizer. The deoxidizer is a deoxidizing metal element (Si, Al, Ti, Mn, etc.), which has stronger affinity for oxygen than Fe, most generally metal aluminum having a purity of 99% or more. It has been found, however, that although Al has a strong deoxidizing power, it extremely decreases the high-temperature yield strength and room-temperature elongation of cast steel. On the other hand, when the Al content is suppressed, a sufficient deoxidizing effect cannot be obtained, resulting in a higher O content in a melt or castings. This leads to the generation of more small cavities such as oxide inclusions and pores (hereinafter referred to as "cavities"), and more gas defects such as pinholes, blowholes, etc. in a casting process. In the high-Cr, high-Ni, heat-resistant, austenitic cast steel of the present invention, the generation of inclusions, cavities and gas defects is suppressed by restricting the Al content to 0.23% or less by weight and the O content to 0.07% or less by weight.

Specifically, the high-Cr, high-Ni, heat-resistant, austenitic cast steel of the present invention preferably comprises by weight 0.2-1.0% of C, 3% or less of Si, 2% or less of Mn, 0.5% or less of S, 15-30% of Cr, 6-30% of Ni, 0.5-6% (as W+2Mo) of W and/or Mo, 0.5-5% of Nb, 0.01-0.5% of N, 0.23% or less of Al, and 0.07% or less of O, the balance being substantially Fe and inevitable impurities. With the main components, and N, Al and O within the above ranges, the high-Cr, high-Ni, heat-resistant, austenitic cast steel is provided with high high-temperature yield strength, oxidation resistance and room-temperature elongation, with a particularly excellent thermal fatigue life when exposed to a high-temperature exhaust gas at 1000° C. or higher.

The preferred composition of the high-Cr, high-Ni, heat-resistant, austenitic cast steel of the present invention comprises by weight 0.3-0.6% of C, 2% or less of Si, 0.5-2% of Mn, 0.05-0.3% of S, 18-27% of Cr, 8-25% of Ni, 1-4% (as W+2Mo) of W and/or Mo, 0.5-2.5% of Nb, 0.05-0.4% of N, 0.17% or less of Al, and 0.06% or less of O, the balance being substantially Fe and inevitable impurities.

Because O is about 6 times as influential as N on the generation of gas defects during casting, the total amount of O and N is expressed by (6O+N). (6O+N) is preferably 0.6% or less by weight. When (6O+N) is 0.6% or less by weight, the high-Cr, high-Ni, heat-resistant, austenitic cast steel has extremely few gas defects, if any.

BRIEF DESCRIPTION OF THE DRAWINGS

FIG. 2(*b*) is a schematic view corresponding to a transmission X-ray photograph of the flat-planar test piece.

FIG. 3(*b*) is a cross-sectional view showing one example of turbine housings.

DESCRIPTION OF THE PREFERRED EMBODIMENTS

Figure 1:
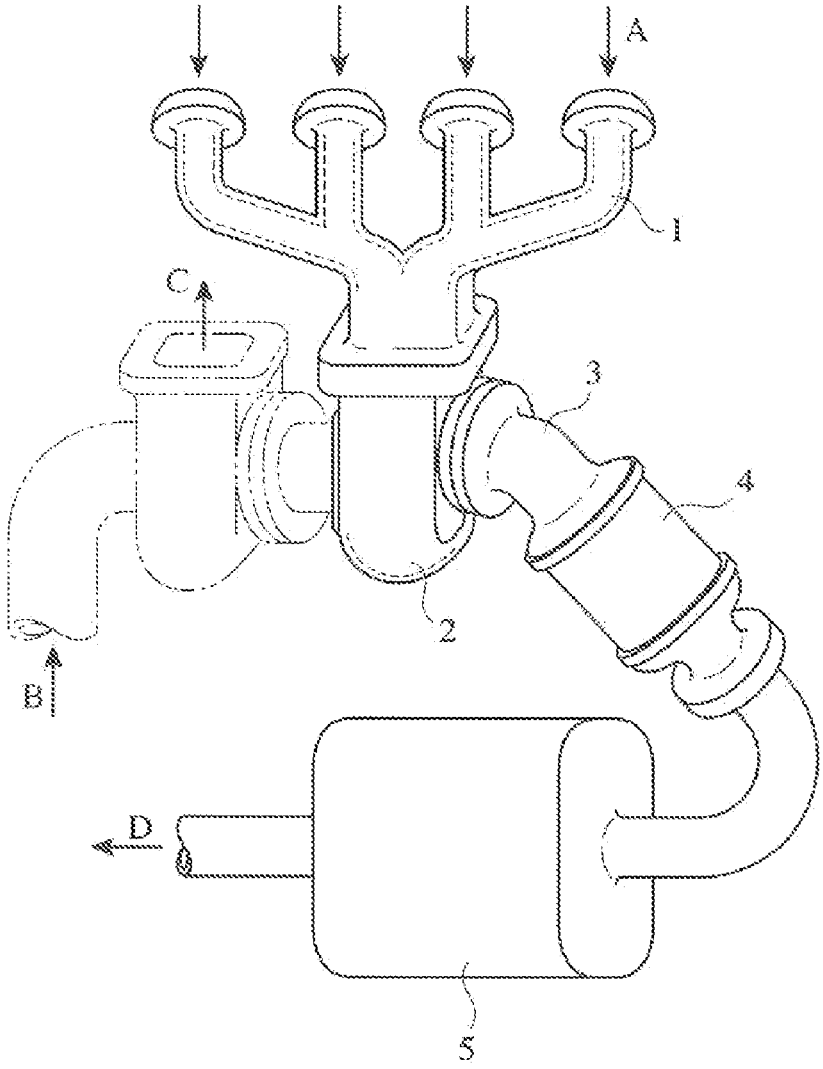
FIG. 1 is a perspective view showing an exhaust equipment member comprising an exhaust manifold, a turbine housing, a connector and a catalyst case.

[1] High-Cr, High-Ni, Heat-Resistant, Austenitic Cast Steel

[A] Composition

The composition of the high-Cr, high-Ni, heat-resistant, austenitic cast steel of the present invention will be explained in detail below, with the amount (%) of each element expressed by weight unless otherwise mentioned.

(1) C (Carbon): 0.2-1.0%

C increases the fluidity (castability) of a melt, and solid-solution-strengthens a matrix. C also forms primary and secondary carbides, increasing the high-temperature strength of the heat-resistant cast steel. Further, it is combined with Nb to form eutectic carbide to increase the castability and improve the high-temperature strength. To exhibit such functions effectively, C should be 0.2% or more. On the other hand, when C exceeds 1.0%, too much eutectic carbide and other carbides are formed, thereby making the heat-resistant cast steel brittle, and providing it with reduced ductility and machinability. Accordingly, the C content is 0.2-1.0%. The preferred C content is 0.3-0.6%.

Although Nb is 8 times as active as C in forming eutectic carbide (NbC), other precipitated carbides need more C than required to form the eutectic carbide. To obtain the high-Cr, high-Ni, heat-resistant, austenitic cast steel having excellent high-temperature strength and castability, (C—Nb/8) is preferably 0.05% or more. However, when (C—Nb/8) exceeds 0.6%, the heat-resistant cast steel becomes too hard and brittle, resulting in having deteriorated ductility and machinability. Accordingly, (C—Nb/8) is preferably 0.05-0.6%. Because the percentage of the eutectic carbide is important to castability particularly in thin castings, (C—Nb/8) is more preferably 0.1-0.5%.

(2) Si (Silicon): 3% or Less

Si is an element acting as a deoxidizer for the melt, and effective for improving the oxidation resistance. However, if contained excessively, the austenitic structure becomes unstable, resulting in deteriorated castability. Accordingly, the Si content is 3% or less, preferably 2% or less.

(3) Mn (Manganese): 2% or Less

Mn is effective as a deoxidizer for the melt like Si, but the inclusion of too much Mn deteriorates the oxidation resistance of the heat-resistant cast steel. Accordingly, the Mn content is 2% or less, preferably 0.5-2%.

(4) S (Sulfur): 0.5% or Less

S forms spherical or granular sulfides in the cast steel, improving the machinability by accelerating the scission of dust in machining. However, the inclusion of too much S results in too much sulfides precipitated in grain boundaries, providing the heat-resistant cast steel with deteriorated high-temperature strength. Accordingly, the S content is 0.5% or less, preferably 0.05-0.3%.

(5) Cr (Chromium): 15-30%

Cr is an essential element forming the heat-resistant, austenitic cast steel, particularly effective to increase the oxidation resistance, and form carbide to enhance the high-temperature strength. To be effective particularly at high temperatures of 1000° C. or higher, 15% or more of Cr should be contained. However, when the Cr content exceeds 30%, excessive secondary carbides are precipitated, and brittle precipitates such as a σ phase, etc. are formed, resulting in extreme embrittlement. Accordingly, the Cr content is 15-30%, preferably 18-27%.

(6) Ni (Nickel): 6-30%

Ni is an essential element forming the heat-resistant, austenitic cast steel like Cr, effectively stabilizing the austenitic structure of the cast steel and increasing the castability. To provide particularly thin exhaust equipment members with good castability, Ni should be 6% or more. However, when Ni exceeds 30%, the effects of improving the above properties are saturated, resulting in only economic disadvantage. Accordingly, the Ni content 6-30%, preferably 8-25%.

As described above, the coexistence of Cr and Ni increases the high-temperature strength and oxidation resistance of the heat-resistant cast steel, accelerates the austenitization of the cast steel structure and the stabilization of the austenitic structure, and improvement in the castability. As a weight ratio of Ni to Cr increases, the oxidation resistance and high-temperature strength of the heat-resistant cast steel are improved. However, even if Ni is contained as much as a Cr/Ni weight ratio becomes less than 1.0, its effect is saturated, economically disadvantageous. On the other hand, when the Cr/Ni weight ratio exceeds 1.5, excessive secondary carbides of Cr are precipitated together with brittle precipitates such as a σ phase, etc., resulting in extreme embrittlement. Accordingly, the Cr/Ni weight ratio is preferably 1.0-1.5.

(7) At Least One of W and Mo: 0.5-6% (W+2Mo)

Because both W and Mo act to improve the high-temperature strength of the heat-resistant cast steel, at least one of them is contained. However, it is not preferable to add them excessively, because they deteriorate the oxidation resistance. When only W is added, the amount of W is 0.5-6%, preferably 1-4%. Because Mo exhibits substantially the same effect as that of W at a ratio of W=2Mo, part or all of W may be substituted by Mo. When only Mo is added, the amount of Mo is 0.25-3%, preferably 0.5-2%. When both of them are added, (W+2Mo) is 0.5-6%, preferably 1-4%.

(8) Nb (Niobium): 0.5-5%

Nb is combined with C to form fine carbide particles, thereby increasing the high-temperature strength and thermal fatigue life of the heat-resistant cast steel, while suppressing the formation of Cr carbides to improve the oxidation resistance and machinability of the heat-resistant cast steel. Further, Nb improves the castability of thin exhaust equipment members by forming the eutectic carbide. Accordingly, the Nb content is 0.5% or more. However, the addition of too much Nb results in too much eutectic carbide formed in grain boundaries, making the heat-resistant cast steel brittle and extremely reducing its strength and ductility. Accordingly, the Nb content has an upper limit of 5% and a lower limit of 0.5%. The Nb content is thus 0.5-5%, preferably 0.5-2.5%.

(9) N (Nitrogen): 0.01-0.5%

N is a strong austenite-forming element, which stabilizes the austenitic matrix of the heat-resistant cast steel, thereby improving its high-temperature strength. It is also an element effective for making crystal grains finer; extremely effective for making finer crystal grains in cast members with complicated shapes, which would not be able to be achieved by working such as forging, rolling, etc. Finer crystal grains increase ductility important to structural members, and solving the problem of low machinability peculiar to the high-Cr, high-Ni, heat-resistant, austenitic cast steel. Also, N reduces the diffusion speed of C, thereby retarding the agglomeration of precipitated carbides and thus preventing carbide particles from becoming coarser. Accordingly, N is effective to prevent the heat-resistant cast steel from becoming brittle.

N is thus extremely effective to improve such properties as high-temperature strength, ductility, toughness, etc., and it improves the high-temperature tensile strength, high-temperature yield strength and room-temperature elongation of the heat-resistant cast steel even in a small amount, thereby drastically improving the thermal fatigue life. To obtain such effect sufficiently, the N content should be 0.01% or more. However, when it exceeds 0.5%, the amount of precipitated nitrides such as $Cr_2N$, etc. increases, rather accelerating the embrittlement of the heat-resistant cast steel, and deteriorating the oxidation resistance of the heat-resistant cast steel because of decrease in the amount of effective Cr in the matrix. N is also combined with Al to precipitate AlN, which extremely deteriorates the toughness at room temperature and high temperatures and decreases the creep strength, if excessive. Further, excessive N accelerates the generation of gas defects such as pinholes, blowholes, etc. during casting, leading to a low casting yield. Accordingly, the N content is 0.01-0.5%, preferably 0.05-0.4%, more preferably 0.1-0.3%.

(10) Al (Aluminum): 0.23% or Less

In the present invention, the Al content is regulated. Al has a strong function to deoxidize the melt, reacting with O to form $Al_2O_3$, oxide inclusion. Because most of $Al_2O_3$ is removed from the melt as slug, Al acts to reduce the amount of O in the cast steel. $Al_2O_3$ remaining in the cast steel functions as a protective layer to oxidation, increasing the oxidation resistance of the cast steel. Also, Al in combination with N precipitates fine AlN particles, making crystal grains in the cast steel finer and thus improving its ductility. However, when a large amount of Al is added to a melt containing large amounts of O and N, large amounts of $Al_2O_3$ and AlN are formed. Part of $Al_2O_3$ remains as the inclusion in the cast steel. Because AlN is extremely hard and brittle, it extremely deteriorates the toughness at room temperature and high temperatures and reduces the creep strength, if precipitated excessively. These inclusions and precipitates act as starting points of cracking and breakage, lowering the high-temperature yield strength and high-temperature tensile strength of the heat-resistant cast steel, and rather deteriorating the oxidation resistance. In addition, because they are hard and brittle, they reduce the room-temperature elongation and the machinability.

It has been found that the limitation of the upper limit of the Al content to 0.23% prevents the high-temperature yield strength and high-temperature tensile strength of the heat-resistant cast steel from decreasing. Accordingly, the Al content is 0.23% or less, preferably 0.17% or less. To reduce the Al content, the O content is regulated, while minimizing the amount of Al added when melted and poured into a ladle.

(11) O (Oxygen): 0.07% or Less

O exists in the cast steel not only as oxide inclusions such as $Al_2O_3$, $SiO_2$, etc. but also as cavities. Because the high-Cr, high-Ni, heat-resistant, austenitic cast steel of the present invention contains a large amount of Cr, a large amount of $Cr_2O_3$ is also formed. The oxide inclusions and the cavities act as the starting points of cracking and breakage, and extremely hard inclusions reduce the ductility, toughness and machinability of the heat-resistant cast steel. Also, excessive O accelerates the growth of austenitic crystal grains by heating, making the heat-resistant cast steel brittle, and accelerating the generation of gas defects such as pinholes, blowholes, etc. during casting. Accordingly, the O content is 0.07% or less, preferably 0.06% or less.

The O content and the Al content are in a contradictory relation in the melt. In general, because the limitation of the Al content in the cast steel tends to increase the O content, regulation should also be made to limit the O content. Specifically, the O content should be suppressed by avoiding materials having large O contents as steel scrap and return scrap (cast return scrap), materials to be molten, and by adjusting the amount of a deoxidizer added based on the contents of O and other elements analyzed before melting. It is also effective to record the O content in each operation, to monitor the variation of the O content depending on operation conditions such as the compositions of materials used, the timing of adding an alloy, the type of a lining, the erosion level of the lining, etc. The amount of O can be maintained to 0.07% or less by these operations.

(12) (6O+N): 0.6% or Less

Because the O content increases by the regulation of the Al content, and because N is added to improve the high-temperature strength, room-temperature elongation and thermal fatigue life of the cast steel, the amounts of O and N tend to become larger in the heat-resistant cast steel of the present invention. To suppress the formation of oxide inclusions, nitrides, cavities, etc. in the cast steel, and to prevent the generation of gas defects such as pinholes, blowholes, etc. during casting, it is preferable to regulate not only the amount of O and N each, but also the total amount of O and N. Because O is about 6 times as influential as N on the generation of gas defects, the total amount of O and N is properly represented by (6O+N). When (6O+N) exceeds 0.6%, gas defects are likely to be generated. Accordingly, (6O+N) is preferably 0.6% or less, more preferably 0.5% or less.

(13) Other Elements

The high-Cr, high-Ni, heat-resistant, austenitic cast steel of the present invention may contain the following elements in ranges not deteriorating the high-temperature yield strength, oxidation resistance, room-temperature elongation and thermal fatigue life of the cast steel.

Co, Cu and B are effective to improve the high-temperature strength, the ductility and the toughness. Particularly Co and Cu are austenite-forming elements, which stabilize the austenitic structure to increase the high-temperature strength like Ni. However, their effects would be saturated if added too much, resulting in only economic disadvantage. Accordingly, when these elements are added, it is preferable that Co is 20% or less, that Cu is 7% or less, and that B is 0.1% or less.

As an element for improving the machinability of the heat-resistant cast steel, at least one selected from the group consisting of Se, Ca, Bi, Te, Sb, Sn and Mg may be added. If it were added too much, however, the effect of improving machinability would be saturated, and the high-temperature strength, the ductility and the toughness would be reduced. Accordingly, when these elements are added, it is preferable that Se is 0.5% or less, that Ca is 0.1% or less, that Bi is 0.5% or less, that Te is 0.5% or less, that Sb is 0.5% or less, that Sn is 0.5% or less, and that Mg is 0.1% or less.

Ta, V, Ti, Zr and Hf are effective not only to improve the high-temperature strength of the heat-resistant cast steel, but also to make crystal grains finer to improve the toughness. However, even if added in a large amount, correspondingly increased effects would not be obtained, rather accelerating the formation of carbides and nitrides, resulting in embrittlement and decrease in the strength and the ductility. Accordingly, when these elements are added, at least one of Ta, V, Ti, Zr and Hf is preferably 5% or less.

Y and rare earth elements (REMs) improve particularly high-temperature oxidation resistance and toughness. Y and REMs form non-metal inclusions, which are dispersed in the matrix to accelerate the scission of dust during machining, thereby improving the machinability of the heat-resistant cast steel. Also, Y and REMs turn inclusions to a spherical or granular shape, improving the ductility of the heat-resistant cast steel. Accordingly, when these elements are added, it is preferable that Y is 1.5% or less, and that the REM is 0.5% or less.

(14) Inevitable Impurities

A main inevitable impurity contained in the high-Cr, high-Ni, heat-resistant, austenitic cast steel of the present invention is P, which is inevitably introduced from starting materials. Because P is segregated in grain boundaries, extremely reducing the toughness, it is preferably as little as possible, desirably 0.1% or less.

[B] Properties

The high-Cr, high-Ni, heat-resistant, austenitic cast steel of the present invention preferably has a thermal fatigue life of 500 cycles or more when measured by a thermal fatigue test comprising heating and cooling at the heating temperature upper limit of 1000° C., a temperature amplitude of 800° C. or more, and a constraint ratio of 0.25. The exhaust equipment member is required to have a long thermal fatigue life to the repetition of operation (heating) and stop (cooling) of an engine. The thermal fatigue life is one of indexes expressing how high the heat resistance and the durability are. The larger the number of cycles is until thermal fatigue fracture occurs by cracking and deformation generated by the repeated heating/cooling in a thermal fatigue test, the longer the thermal fatigue life is, meaning excellent heat resistance and durability.

The thermal fatigue life is evaluated, for instance, by repeatedly subjecting a smooth, round-rod test piece having a gauge length of 25 mm and a diameter of 10 mm to heating/cooling cycles in the air, each cycle having the heating temperature upper limit of 1000° C., the cooling temperature lower limit of 150° C., and a temperature amplitude of 800° C. or more for 7 minutes in total (temperature-elevating time: 2 minutes, temperature-holding time: 1 minute, and cooling time: 4 minutes), to cause thermal fatigue fracture while mechanically constraining the elongation and shrinkage of the test piece due to heating and cooling. The thermal fatigue life used herein is represented by the number of cycles until the load decreases by 25% from a reference load, which is the maximum tensile load generated at the cooling temperature lower limit in the second cycle in a load-temperature line determined from load change caused by repeated heating and cooling. The level of the mechanical constraint is represented by a constraint ratio defined by (elongation by free thermal expansion-elongation by thermal expansion under mechanical constraint)/(elongation by free thermal expansion). The constraint ratio of 1.0 means the mechanical constraint condition that a test piece is not elongated at all, for instance, when heated from 150° C. to 1000° C. The constraint ratio of 0.5 means the mechanical constraint condition that for instance, when the elongation by free thermal expansion is 2 mm, the thermal expansion causes 1-mm elongation. Accordingly, at a constraint ratio of 0.5, a compression load is applied during temperature elevation, and a tensile load (out-of-phase load) is applied during temperature lowering. The constraint ratios of exhaust equipment members for actual automobile engines are about 0.1-0.5, at which elongation is permitted to some extent.

When the high-Cr, high-Ni, heat-resistant, austenitic cast steel has a thermal fatigue life of 500 cycles or more at the heating temperature upper limit of 1000° C., a temperature amplitude of 800° C. or more, and a constraint ratio of 0.25, it may be said that the cast steel has an excellent thermal fatigue life, suitable for exhaust equipment members exposed to a high-temperature exhaust gas at 1000° C. or higher. The exhaust equipment members made of the high-Cr, high-Ni, heat-resistant, austenitic cast steel of the present invention exhibit excellent heat resistance and durability in an environment exposed to an exhaust gas at 1000° C. or higher, with a sufficiently long life until the thermal fatigue fracture occurs.

The high-Cr, high-Ni, heat-resistant, austenitic cast steel more preferably has a thermal fatigue life of 300 cycles or more when measured by a thermal fatigue test comprising heating and cooling at the heating temperature upper limit of 1000° C., a temperature amplitude of 800° C. or more, and a constraint ratio of 0.5. If the thermal fatigue life is 300 cycles or more with the constraint ratio changed from 0.25 to 0.5 for a severer mechanical constraint condition, it may be said that the cast steel has excellent heat resistance and durability and a sufficient life until the thermal fatigue fracture occurs, further suitable for exhaust equipment members exposed to an exhaust gas at 1000° C. or higher.

Because the exhaust equipment members are required to have high high-temperature yield strength to exhibit enough thermal deformation resistance, the high-Cr, high-Ni, heat-resistant, austenitic cast steel of the present invention preferably has excellent high-temperature yield strength and room-temperature elongation. Specifically, it preferably has a 0.2-% yield strength of 50 MPa or more at 1050° C., and a room-temperature elongation of 2.0% or more. If the 0.2-% yield strength at 1050° C. is 50 MPa or more, the exhaust equipment members have sufficient strength to compression stress generated under constraint at high temperatures, thereby having sufficient durability. The 0.2-% yield strength of the high-Cr, high-Ni, heat-resistant, austenitic cast steel at 1050° C. is more preferably 60 MPa or more.

If the high-Cr, high-Ni, heat-resistant, austenitic cast steel has a room-temperature elongation of 2.0% or more, cooling from high temperatures to around room temperature would not crack or break the exhaust equipment members under tensile stress turned from compression stress generated at high temperatures. Also, if the room-temperature elongation is 2.0% or more, cracking and breakage can be suppressed against mechanical vibration and shock occurring in the production processes of exhaust equipment members, in the processes of assembling to engines, at the start of or during the driving of automobiles, etc. Accordingly, the room-temperature elongation of the high-Cr, high-Ni, heat-resistant, austenitic cast steel is 2.0% or more, preferably 2.8% or more, more preferably 3.0% or more. The exhaust equipment members made of the high-Cr, high-Ni, heat-resistant, austenitic cast steel having excellent high-temperature yield strength and room-temperature elongation are sufficiently durable even when repeatedly heated and cooled by a high-temperature exhaust gas between about room temperature and 1000° C. or higher.

[2] Exhaust Equipment Members

The exhaust equipment member of the present invention is formed by the above high-Cr, high-Ni, heat-resistant, austenitic cast steel. Preferred examples of the exhaust equipment members include an exhaust manifold, a turbine housing, an exhaust manifold integrally cast with a turbine housing, a catalyst case, an exhaust manifold integrally cast with a catalyst case, and an exhaust outlet. The exhaust equipment member of the present invention exhibits excellent durability even when exposed to a high-temperature exhaust gas at 1000° C. or higher. In addition, with part of paths in the exhaust equipment member in contact with an exhaust gas made as thin as 5 mm or less, further 4 mm or less, and with the exhaust equipment member disposed on the rear side of an engine, the initial performance of an exhaust-gas-cleaning catalyst can be improved.

FIG. 1 shows one example of exhaust equipment members, which comprises an exhaust manifold 1, a turbine housing 2, an exhaust outlet, a diffuser, a connector 3 called a connecting flange, etc., and a catalyst case 4. An exhaust gas (shown by the arrow A) from an engine (not shown) is gathered in the exhaust manifold 1 to rotate a turbine (not shown) in the turbine housing 2 by its kinetic energy, thereby driving a compressor coaxial with the turbine to compress the inhaled air (shown by the arrow B). As a result, a high-density air is supplied to the engine (shown by the arrow C) to increase the power of the engine. The exhaust gas from the turbine housing 2 flows through the connector 3 to the catalyst case 4, in which toxic substance is removed from the exhaust gas by a catalyst, and discharged to the air through a muffler 5 (shown by the arrow D).

As long as casting conditions such as parting lines, mold designs, etc. permit, the exhaust manifold 1 may be integrally cast with the turbine housing 2. Also, when there is no turbine housing 2, the exhaust manifold 1 may be integrally cast with the catalyst case 4.

In the exhaust equipment member shown in FIG. 1, main portions of the exhaust gas path have complicated shapes, usually as thin as 2.0-4.5 mm in the exhaust manifold 1, 2.5-5.0 mm in the turbine housing 2, 2.5-3.5 mm in the connector 3, and 2.0-2.5 mm in the catalyst case 4.

Figure 3A:
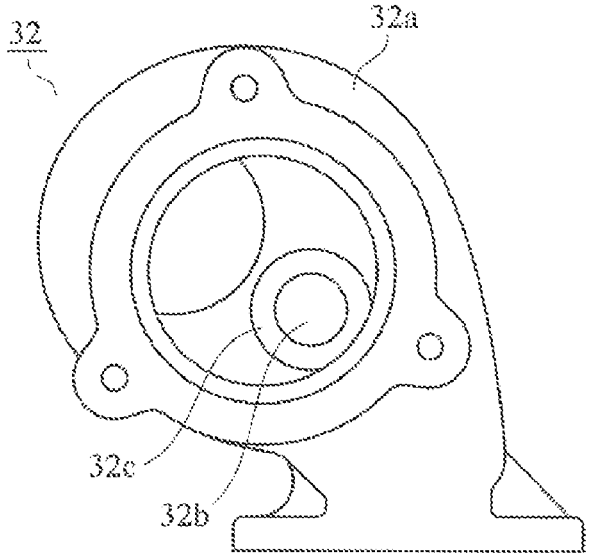
FIG. 3(*a*) is a side view showing one example of turbine housings.
Figure 3B:
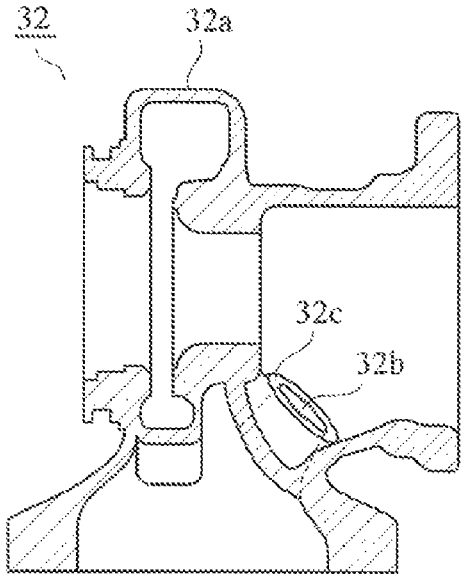

FIGS. 3(*a*) and 3(*b*) show a turbine housing 32, which comprises a scroll 32*a* having a complicated-shaped space like a spiral shell, whose cross section area increases from one end to the other. The turbine housing 32 is provided with a waist gate 32*b* comprising a valve (not shown), which is opened to form a bypass to discharge an excessive exhaust gas. The waist gate 32*b* is particularly required to have high thermal cracking resistance among various portions of the turbine housing, because a high-temperature exhaust gas flows through the waist gate 32*b*.

The present invention will be explained in more detail by means of Examples below without intention of restricting the present invention to them. Unless otherwise mentioned, the amount (%) of each element is expressed by weight.

Examples 1-47, Comparative Examples 1-14

Tables 1-1 to 1-4 show the chemical compositions of the heat-resistant cast steel samples of Examples 1-47, and Tables 2-1 and 2-2 show the chemical compositions of the heat-resistant cast steel samples of Comparative Examples 1-14. The cast steel contains too much Al in Comparative Examples 1-8, too little N in Comparative Example 9, too much N in Comparative Example 10, too much O in Comparative Examples 11 and 12, and too much O and N in Comparative Example 13. Comparative Example 14 shows one example of the high-Cr, high-Ni, heat-resistant, austenitic cast steel described in JP2000-291430A.

Each cast steel of Examples 1-47 and Comparative Examples 1-14 was melted in a 100-kg, high-frequency melting furnace with a base lining in the air, tapped from the furnace at 1550° C. or higher, and immediately poured into a one-inch Y-block of 25 mm×25 mm×165 mm at 1500° C. or higher to form a sample.

TABLE 1-1

Compositions of Samples of Examples (% by weight)

| No. | C | Si | Mn | S | Cr | Ni | W | Mo | W + 2Mo | Nb |
|---|---|---|---|---|---|---|---|---|---|---|
| Example 1 | 0.21 | 0.25 | 0.16 | 0.02 | 15.4 | 6.3 | 0.52 | — | 0.52 | 0.50 |
| Example 2 | 0.28 | 0.36 | 0.25 | 0.04 | 16.8 | 7.4 | 0.73 | — | 0.73 | 0.65 |
| Example 3 | 0.31 | 0.55 | 0.51 | 0.05 | 18.1 | 8.1 | 1.02 | — | 1.02 | 0.51 |
| Example 4 | 0.56 | 1.04 | 1.23 | 0.13 | 27.6 | 20.4 | 3.23 | — | 3.23 | 2.28 |
| Example 5 | 0.50 | 0.48 | 0.87 | 0.15 | 24.0 | 19.9 | 2.92 | — | 2.92 | 1.94 |
| Example 6 | 0.49 | 0.39 | 0.88 | 0.15 | 24.4 | 19.7 | 2.96 | — | 2.96 | 1.96 |
| Example 7 | 0.53 | 1.17 | 1.25 | 0.12 | 26.8 | 18.7 | 3.05 | — | 3.05 | 2.02 |
| Example 8 | 0.30 | 0.53 | 0.52 | 0.05 | 18.0 | 8.2 | — | 0.25 | 0.50 | 0.52 |
| Example 9 | 0.56 | 0.77 | 1.04 | 0.15 | 25.3 | 20.3 | 3.19 | — | 3.19 | 2.05 |
| Example 10 | 0.57 | 0.99 | 0.72 | 0.18 | 24.8 | 19.6 | 3.04 | — | 3.04 | 1.89 |
| Example 11 | 0.51 | 0.88 | 0.96 | 0.16 | 23.5 | 17.8 | 2.98 | — | 2.98 | 2.14 |
| Example 12 | 0.49 | 1.58 | 1.21 | 0.17 | 25.8 | 19.1 | 3.11 | — | 3.11 | 0.94 |
| Example 13 | 0.50 | 0.82 | 1.15 | 0.12 | 24.6 | 21.2 | 3.04 | — | 3.04 | 1.53 |
| Example 14 | 0.50 | 1.59 | 1.46 | 0.11 | 27.0 | 18.5 | 3.28 | — | 3.28 | 0.82 |
| Example 15 | 0.41 | 1.01 | 0.50 | 0.11 | 18.2 | 18.3 | 1.63 | — | 1.63 | 0.70 |
| Example 16 | 0.49 | 1.41 | 1.36 | 0.15 | 23.9 | 17.7 | 3.30 | — | 3.30 | 1.23 |
| Example 17 | 0.51 | 1.49 | 1.26 | 0.16 | 23.4 | 17.5 | 3.23 | — | 3.23 | 0.84 |
| Example 18 | 0.29 | 0.49 | 0.48 | 0.03 | 17.9 | 7.8 | — | 0.52 | 1.04 | 0.72 |

TABLE 1-1-continued

| Compositions of Samples of Examples (% by weight) | | | | | | | | | | |
|---|---|---|---|---|---|---|---|---|---|---|
| No. | C | Si | Mn | S | Cr | Ni | W | Mo | W + 2Mo | Nb |
| Example 19 | 0.35 | 0.67 | 0.64 | 0.09 | 20.3 | 12.2 | 1.84 | — | 1.84 | 0.65 |
| Example 20 | 0.39 | 0.72 | 0.76 | 0.08 | 19.7 | 10.9 | — | 0.80 | 1.60 | 0.73 |
| Example 21 | 0.59 | 1.95 | 1.65 | 0.30 | 26.9 | 25.0 | 3.98 | — | 3.98 | 2.50 |
| Example 22 | 0.55 | 1.68 | 1.22 | 0.19 | 26.8 | 22.0 | 3.38 | — | 3.38 | 2.28 |
| Example 23 | 0.46 | 1.35 | 0.90 | 0.14 | 24.9 | 19.6 | 2.98 | — | 2.98 | 0.82 |
| Example 24 | 0.58 | 2.57 | 1.43 | 0.28 | 26.8 | 24.8 | 3.82 | — | 3.82 | 2.47 |
| Example 25 | 0.46 | 0.84 | 0.85 | 0.15 | 24.6 | 19.7 | 3.22 | — | 3.22 | 1.01 |
| Example 26 | 0.49 | 0.81 | 0.86 | 0.15 | 24.2 | 19.3 | 2.93 | — | 2.93 | 1.04 |
| Example 27 | 0.57 | 2.62 | 1.38 | 0.35 | 26.5 | 24.5 | — | 1.68 | 3.36 | 2.42 |
| Example 28 | 0.36 | 0.93 | 0.68 | 0.09 | 18.5 | 16.4 | 1.75 | — | 1.75 | 0.94 |
| Example 29 | 0.42 | 0.98 | 1.01 | 0.11 | 22.1 | 18.3 | 1.64 | 0.51 | 2.66 | 0.78 |
| Example 30 | 0.40 | 0.77 | 0.73 | 0.10 | 21.8 | 17.6 | 1.14 | 0.23 | 1.60 | 0.75 |

TABLE 1-2

| Compositions of Samples of Examples (% by weight) | | | | | | | | | | |
|---|---|---|---|---|---|---|---|---|---|---|
| No. | C | Si | Mn | S | Cr | Ni | W | Mo | W + 2Mo | Nb |
| Example 31 | 0.38 | 0.86 | 0.54 | 0.06 | 16.3 | 15.7 | 0.48 | 0.26 | 1.00 | 0.81 |
| Example 32 | 0.41 | 1.03 | 0.96 | 0.13 | 23.9 | 19.2 | 2.01 | 0.69 | 3.39 | 0.81 |
| Example 33 | 0.46 | 0.87 | 0.90 | 0.15 | 24.7 | 19.6 | 2.81 | — | 2.81 | 0.80 |
| Example 34 | 0.43 | 1.27 | 0.86 | 0.14 | 23.9 | 19.4 | 2.88 | — | 2.88 | 1.17 |
| Example 35 | 0.45 | 0.41 | 0.87 | 0.15 | 24.5 | 19.5 | 3.07 | — | 3.07 | 1.14 |
| Example 36 | 0.41 | 1.27 | 0.94 | 0.15 | 24.7 | 20.1 | 3.25 | — | 3.25 | 1.12 |
| Example 37 | 0.66 | 2.75 | 1.77 | 0.38 | 27.4 | 26.7 | — | 1.98 | 3.96 | 2.30 |
| Example 38 | 0.75 | 2.84 | 1.86 | 0.42 | 28.8 | 28.7 | 4.21 | 0.71 | 5.63 | 3.49 |
| Example 39 | 0.49 | 0.81 | 1.51 | 0.14 | 26.6 | 18.5 | 3.27 | — | 3.27 | 0.84 |
| Example 40 | 0.48 | 1.29 | 1.45 | 0.12 | 24.9 | 21.3 | 2.81 | — | 2.81 | 0.75 |
| Example 41 | 0.63 | 2.80 | 1.82 | 0.33 | 27.1 | 25.3 | 3.75 | — | 3.75 | 2.57 |
| Example 42 | 0.53 | 1.48 | 1.22 | 0.20 | 23.3 | 19.6 | 3.18 | — | 3.18 | 0.91 |
| Example 43 | 0.84 | 2.91 | 1.93 | 0.45 | 29.0 | 28.8 | 5.89 | — | 5.89 | 4.76 |
| Example 44 | 0.83 | 2.93 | 1.89 | 0.41 | 28.7 | 28.1 | — | 2.89 | 5.78 | 4.72 |
| Example 45 | 0.95 | 2.95 | 1.94 | 0.47 | 29.4 | 29.7 | 5.45 | — | 5.45 | 4.89 |
| Example 46 | 0.45 | 0.38 | 1.02 | 0.16 | 25.3 | 20.8 | 2.85 | — | 2.85 | 2.05 |
| Example 47 | 0.48 | 1.44 | 1.08 | 0.18 | 24.8 | 19.7 | 2.93 | — | 2.93 | 1.99 |

TABLE 1-3

| Compositions of Samples of Examples (% by weight) | | | | | |
|---|---|---|---|---|---|
| No. | Al | N | O | 6O + N | Fe |
| Example 1 | 0.001 | 0.011 | 0.068 | 0.419 | Balance |
| Example 2 | 0.003 | 0.023 | 0.062 | 0.395 | Balance |
| Example 3 | 0.011 | 0.051 | 0.059 | 0.405 | Balance |
| Example 4 | 0.184 | 0.058 | 0.021 | 0.184 | Balance |
| Example 5 | 0.182 | 0.066 | 0.016 | 0.164 | Balance |
| Example 6 | 0.179 | 0.075 | 0.014 | 0.159 | Balance |
| Example 7 | 0.187 | 0.077 | 0.019 | 0.191 | Balance |
| Example 8 | 0.007 | 0.078 | 0.066 | 0.474 | Balance |
| Example 9 | 0.195 | 0.081 | 0.014 | 0.168 | Balance |
| Example 10 | 0.175 | 0.089 | 0.019 | 0.203 | Balance |
| Example 11 | 0.206 | 0.094 | 0.014 | 0.176 | Balance |
| Example 12 | 0.220 | 0.095 | 0.012 | 0.168 | Balance |
| Example 13 | 0.219 | 0.100 | 0.013 | 0.178 | Balance |
| Example 14 | 0.154 | 0.102 | 0.021 | 0.230 | Balance |
| Example 15 | 0.025 | 0.112 | 0.050 | 0.412 | Balance |
| Example 16 | 0.102 | 0.129 | 0.033 | 0.327 | Balance |
| Example 17 | 0.120 | 0.136 | 0.028 | 0.306 | Balance |
| Example 18 | 0.033 | 0.145 | 0.053 | 0.463 | Balance |
| Example 19 | 0.035 | 0.151 | 0.046 | 0.427 | Balance |
| Example 20 | 0.054 | 0.152 | 0.047 | 0.434 | Balance |
| Example 21 | 0.084 | 0.153 | 0.038 | 0.381 | Balance |
| Example 22 | 0.069 | 0.155 | 0.039 | 0.389 | Balance |
| Example 23 | 0.093 | 0.162 | 0.033 | 0.359 | Balance |
| Example 24 | 0.097 | 0.167 | 0.026 | 0.323 | Balance |
| Example 25 | 0.061 | 0.168 | 0.037 | 0.391 | Balance |
| Example 26 | 0.101 | 0.172 | 0.030 | 0.354 | Balance |
| Example 27 | 0.091 | 0.175 | 0.035 | 0.385 | Balance |
| Example 28 | 0.008 | 0.178 | 0.037 | 0.400 | Balance |

TABLE 1-3-continued

| Compositions of Samples of Examples (% by weight) | | | | | |
|---|---|---|---|---|---|
| No. | Al | N | O | 6O + N | Fe |
| Example 29 | 0.058 | 0.179 | 0.032 | 0.371 | Balance |
| Example 30 | 0.037 | 0.180 | 0.036 | 0.396 | Balance |

TABLE 1-4

| Compositions of Samples of Examples (% by weight) | | | | | |
|---|---|---|---|---|---|
| No. | Al | N | O | 6O + N | Fe |
| Example 31 | 0.028 | 0.182 | 0.039 | 0.416 | Balance |
| Example 32 | 0.068 | 0.186 | 0.029 | 0.360 | Balance |
| Example 33 | 0.042 | 0.195 | 0.040 | 0.436 | Balance |
| Example 34 | 0.074 | 0.196 | 0.035 | 0.407 | Balance |
| Example 35 | 0.071 | 0.200 | 0.036 | 0.416 | Balance |
| Example 36 | 0.011 | 0.207 | 0.046 | 0.480 | Balance |
| Example 37 | 0.115 | 0.223 | 0.021 | 0.349 | Balance |
| Example 38 | 0.160 | 0.235 | 0.027 | 0.397 | Balance |
| Example 39 | 0.012 | 0.250 | 0.055 | 0.580 | Balance |
| Example 40 | 0.146 | 0.256 | 0.026 | 0.412 | Balance |
| Example 41 | 0.169 | 0.298 | 0.022 | 0.430 | Balance |
| Example 42 | 0.131 | 0.300 | 0.022 | 0.432 | Balance |
| Example 43 | 0.187 | 0.378 | 0.015 | 0.468 | Balance |
| Example 44 | 0.212 | 0.389 | 0.018 | 0.497 | Balance |
| Example 45 | 0.225 | 0.481 | 0.017 | 0.583 | Balance |
| Example 46 | 0.008 | 0.426 | 0.036 | 0.642 | Balance |
| Example 47 | 0.004 | 0.498 | 0.045 | 0.768 | Balance |

TABLE 2-1

Compositions of Samples of Comparative Examples (% by weight)

| No. | C | Si | Mn | S | Cr | Ni | W | Mo | W + 2Mo | Nb |
|---|---|---|---|---|---|---|---|---|---|---|
| Com. Ex. 1 | 0.52 | 0.44 | 1.07 | 0.11 | 27.5 | 22.4 | 2.91 | — | 2.91 | 1.79 |
| Com. Ex. 2 | 0.49 | 0.41 | 1.14 | 0.16 | 27.6 | 18.2 | 2.85 | — | 2.85 | 2.23 |
| Com. Ex. 3 | 0.50 | 0.50 | 0.98 | 0.18 | 24.6 | 21.0 | 2.89 | — | 2.89 | 2.02 |
| Com. Ex. 4 | 0.50 | 0.80 | 0.97 | 0.15 | 24.7 | 20.8 | 2.93 | — | 2.93 | 1.58 |
| Com. Ex. 5 | 0.48 | 0.77 | 1.22 | 0.18 | 23.3 | 18.5 | 3.15 | — | 3.15 | 1.80 |
| Com. Ex. 6 | 0.48 | 0.78 | 1.16 | 0.15 | 26.7 | 22.2 | 3.23 | — | 3.23 | 2.14 |
| Com. Ex. 7 | 0.53 | 0.69 | 1.01 | 0.15 | 25.2 | 19.7 | 2.95 | — | 2.95 | 2.18 |
| Com. Ex. 8 | 0.49 | 0.33 | 1.23 | 0.16 | 24.7 | 19.8 | 2.80 | — | 2.80 | 2.21 |
| Com. Ex. 9 | 0.49 | 0.36 | 0.96 | 0.14 | 24.9 | 19.4 | 2.86 | — | 2.86 | 2.04 |
| Com. Ex. 10 | 0.50 | 0.59 | 1.08 | 0.14 | 25.0 | 19.2 | 2.94 | — | 2.94 | 1.97 |
| Com. Ex. 11 | 0.53 | 0.55 | 1.05 | 0.16 | 24.0 | 19.2 | 2.94 | — | 2.94 | 1.98 |
| Com. Ex. 12 | 0.48 | 0.68 | 0.95 | 0.15 | 25.8 | 19.7 | 3.08 | — | 3.08 | 1.95 |
| Com. Ex. 13 | 0.51 | 0.53 | 1.05 | 0.16 | 24.9 | 19.8 | 3.11 | — | 3.11 | 2.13 |
| Com. Ex. 14 | 0.46 | 0.39 | 0.88 | 0.15 | 24.4 | 19.7 | 3.00 | — | 3.00 | 2.01 |

TABLE 2-2

Compositions of Samples of Comparative Examples (% by weight)

| No. | Al | N | O | 6O + N | Fe |
|---|---|---|---|---|---|
| Com. Ex. 1 | 0.241 | 0.017 | 0.010 | 0.077 | Balance |
| Com. Ex. 2 | 0.245 | 0.032 | 0.009 | 0.087 | Balance |
| Com. Ex. 3 | 0.250 | 0.023 | 0.006 | 0.061 | Balance |
| Com. Ex. 4 | 0.258 | 0.018 | 0.009 | 0.072 | Balance |
| Com. Ex. 5 | 0.276 | 0.042 | 0.008 | 0.090 | Balance |
| Com. Ex. 6 | 0.280 | 0.038 | 0.005 | 0.068 | Balance |
| Com. Ex. 7 | 0.336 | 0.163 | 0.004 | 0.187 | Balance |
| Com. Ex. 8 | 0.418 | 0.171 | 0.005 | 0.201 | Balance |
| Com. Ex. 9 | 0.007 | 0.005 | 0.035 | 0.215 | Balance |
| Com. Ex. 10 | 0.024 | 0.583 | 0.032 | 0.775 | Balance |
| Com. Ex. 11 | 0.003 | 0.153 | 0.078 | 0.621 | Balance |
| Com. Ex. 12 | 0.001 | 0.174 | 0.092 | 0.726 | Balance |
| Com. Ex. 13 | 0.006 | 0.566 | 0.083 | 1.064 | Balance |
| Com. Ex. 14 | 0.272 | 0.008 | 0.002 | 0.020 | Balance |

Each sample was subjected to the following evaluations.

(1) Thermal Fatigue Life

To evaluate a thermal fatigue life, a smooth, round-rod test piece having a gauge length of 25 mm and a diameter of 10 mm cut out of each sample was mounted to a hydraulic servo material tester (SERVOPULSER EHF-ED 10TF-20L available from Shimadzu Corp.) at two constraint ratios of 0.25 and 0.5, respectively, which expressed the level of mechanical constraint in elongation and shrinkage caused by heating and cooling. At each constraint ratio, each test piece was repeatedly subjected to heating/cooling cycles in the air, each cycle having the cooling temperature lower limit of 150° C., the heating temperature upper limit of 1000° C., and a temperature amplitude of 850° C. for 7 minutes in total (temperature-elevating time: 2 minutes, temperature-holding time: 1 minute, and cooling time: 4 minutes). The number of heating/cooling cycles was counted until the maximum tensile load in a load-temperature line in the second cycle was reduced by 25%, which was determined as the thermal fatigue life. The test results are shown in Tables 3-1 to 3-3 (simply Table 3).

As is clear from Table 3, the test pieces of Examples except for Examples 1 and 2 exhibited longer thermal fatigue lives than the maximum ones (274 cycles at a constraint ratio of 0.25, and 138 cycles at a constraint ratio of 0.5) of Comparative Examples 1-14. This confirms that the heat-resistant cast steel of the present invention has excellent thermal fatigue life.

In Examples 1-40, as the N content increases, the thermal fatigue life tends to increase. The comparison of Example 46 and Comparative Example 9 having substantially the same composition ranges of elements other than N in thermal fatigue life revealed that the test piece of Example 46 containing 0.426% of N (within the range of the present invention) had about 4 times as long thermal fatigue life as that of the test piece of Comparative Example 9 containing only 0.005% of N, indicating that the inclusion of N drastically improves the thermal fatigue life. However, the test piece of Comparative Example 10 shows that as excessive N as 0.5% rather shortens the thermal fatigue life. This appears to be due to the fact that too much N promotes the formation of nitrides, cavities and gas defects acting as the starting points of cracking and breakage, resulting in decrease in high-temperature yield strength and high-temperature tensile strength.

TABLE 3-1

Evaluation Results of Examples

| | Thermal Fatigue Life (cycles) at Constraint Ratio | | High-Temp. Yield Strength (MPa) at | High-Temp. Tensile Strength (MPa) at | Room-Temp. Elongation | Weight Loss By Oxidation ($mg/cm^2$) at | | Area Ratio of Gas Defects |
|---|---|---|---|---|---|---|---|---|
| No. | 0.25 | 0.5 | 1050° C. | 1050° C. | (%) at 25° C. | 1000° C. | 1050° C. | (%) |
| Ex. 1 | 205 | 96 | 83 | 135 | 2.3 | 23 | 30 | 6.4 |
| Ex. 2 | 206 | 108 | 79 | 130 | 2.3 | 21 | 30 | 4.0 |
| Ex. 3 | 373 | 153 | 78 | 129 | 2.8 | 19 | 28 | 5.8 |
| Ex. 4 | 528 | 250 | 37 | 88 | 2.8 | 8 | 7 | 4.2 |
| Ex. 5 | 461 | 249 | 35 | 88 | 2.8 | 7 | 10 | 3.5 |
| Ex. 6 | 461 | 260 | 32 | 86 | 3.0 | 8 | 12 | 0.5 |
| Ex. 7 | 546 | 230 | 33 | 90 | 2.9 | 8 | 11 | 2.2 |
| Ex. 8 | 433 | 186 | 81 | 131 | 2.9 | 21 | 28 | 5.5 |
| Ex. 9 | 460 | 222 | 36 | 85 | 2.9 | 7 | 7 | 4.3 |

TABLE 3-1-continued

Evaluation Results of Examples

| No. | Thermal Fatigue Life (cycles) at Constraint Ratio 0.25 | Thermal Fatigue Life (cycles) at Constraint Ratio 0.5 | High-Temp. Yield Strength (MPa) at 1050° C. | High-Temp. Tensile Strength (MPa) at 1050° C. | Room-Temp. Elongation (%) at 25° C. | Weight Loss By Oxidation ($mg/cm^2$) at 1000° C. | Weight Loss By Oxidation ($mg/cm^2$) at 1050° C. | Area Ratio of Gas Defects (%) |
|---|---|---|---|---|---|---|---|---|
| Ex. 10 | 585 | 240 | 38 | 88 | 2.9 | 9 | 10 | 4.7 |
| Ex. 11 | 512 | 265 | 35 | 87 | 3.0 | 9 | 10 | 5.1 |
| Ex. 12 | 700 | 286 | 35 | 87 | 3.0 | 8 | 9 | 2.5 |
| Ex. 13 | 600 | 300 | 35 | 89 | 3.2 | 8 | 9 | 1.2 |
| Ex. 14 | 609 | 375 | 45 | 92 | 3.3 | 9 | 10 | 3.2 |
| Ex. 15 | 473 | 215 | 75 | 125 | 3.3 | 20 | 24 | 5.4 |
| Ex. 16 | 616 | 371 | 46 | 96 | 3.5 | 8 | 7 | 2.4 |
| Ex. 17 | 501 | 314 | 44 | 96 | 3.5 | 8 | 9 | 2.7 |
| Ex. 18 | 655 | 301 | 79 | 130 | 4.0 | 21 | 28 | 2.6 |
| Ex. 19 | 660 | 305 | 75 | 123 | 4.0 | 23 | 28 | 4.6 |
| Ex. 20 | 663 | 306 | 73 | 121 | 4.1 | 21 | 29 | 1.7 |
| Ex. 21 | 700 | 368 | 65 | 115 | 3.9 | 8 | 9 | 3.6 |
| Ex. 22 | 682 | 315 | 63 | 113 | 4.0 | 8 | 9 | 5.2 |
| Ex. 23 | 767 | 411 | 55 | 103 | 4.0 | 7 | 8 | 1.3 |
| Ex. 24 | 860 | 391 | 51 | 103 | 4.2 | 7 | 8 | 1.6 |
| Ex. 25 | 797 | 441 | 62 | 110 | 4.2 | 8 | 7 | 2.4 |
| Ex. 26 | 871 | 518 | 53 | 105 | 4.1 | 8 | 11 | 3.2 |
| Ex. 27 | 755 | 339 | 60 | 110 | 4.3 | 7 | 7 | 2.5 |
| Ex. 28 | 823 | 408 | 65 | 115 | 4.2 | 18 | 24 | 1.4 |
| Ex. 29 | 892 | 440 | 52 | 103 | 4.2 | 12 | 16 | 4.3 |
| Ex. 30 | 890 | 439 | 56 | 107 | 4.3 | 13 | 16 | 4.6 |

TABLE 3-2

Evaluation Results of Examples

| No. | Thermal Fatigue Life (cycles) at Constraint Ratio 0.25 | Thermal Fatigue Life (cycles) at Constraint Ratio 0.5 | High-Temp. Yield Strength (MPa) at 1050° C. | High-Temp. Tensile Strength (MPa) at 1050° C. | Room-Temp. Elongation (%) at 25° C. | Weight Loss By Oxidation ($mg/cm^2$) at 1000° C. | Weight Loss By Oxidation ($mg/cm^2$) at 1050° C. | Area Ratio of Gas Defects (%) |
|---|---|---|---|---|---|---|---|---|
| Ex. 31 | 893 | 442 | 60 | 110 | 4.4 | 14 | 18 | 0.9 |
| Ex. 32 | 842 | 330 | 51 | 102 | 4.3 | 8 | 13 | 5.4 |
| Ex. 33 | 918 | 562 | 61 | 113 | 4.3 | 7 | 8 | 2.2 |
| Ex. 34 | 980 | 516 | 59 | 106 | 4.4 | 7 | 8 | 3.8 |
| Ex. 35 | 1015 | 566 | 57 | 105 | 4.5 | 7 | 8 | 2.8 |
| Ex. 36 | 1095 | 565 | 73 | 123 | 4.5 | 8 | 7 | 1.9 |
| Ex. 37 | 1205 | 578 | 50 | 101 | 4.5 | 7 | 7 | 4.9 |
| Ex. 38 | 1193 | 563 | 51 | 101 | 4.7 | 6 | 7 | 5.7 |
| Ex. 39 | 2011 | 923 | 76 | 129 | 5.1 | 9 | 11 | 7.5 |
| Ex. 40 | 2088 | 1026 | 45 | 96 | 5.0 | 7 | 10 | 2.1 |
| Ex. 41 | 1862 | 810 | 48 | 99 | 5.3 | 7 | 8 | 4.3 |
| Ex. 42 | 1753 | 807 | 47 | 97 | 5.9 | 9 | 9 | 3.7 |
| Ex. 43 | 2006 | 974 | 30 | 80 | 6.4 | 7 | 7 | 6.1 |
| Ex. 44 | 1641 | 796 | 39 | 91 | 6.2 | 7 | 7 | 6.5 |
| Ex. 45 | 957 | 542 | 38 | 89 | 6.3 | 9 | 13 | 8.4 |
| Ex. 46 | 855 | 413 | 79 | 130 | 4.5 | 10 | 17 | 10.8 |
| Ex. 47 | 482 | 236 | 80 | 129 | 3.2 | 18 | 26 | 12.8 |

TABLE 3-3

Evaluation Results of Examples

| No. | Thermal Fatigue Life (cycles) at Constraint Ratio 0.25 | Thermal Fatigue Life (cycles) at Constraint Ratio 0.5 | High-Temp. Yield Strength (MPa) at 1050° C. | High-Temp. Tensile Strength (MPa) at 1050° C. | Room-Temp. Elongation (%) at 25° C. | Weight Loss By Oxidation ($mg/cm^2$) at 1000° C. | Weight Loss By Oxidation ($mg/cm^2$) at 1050° C. | Area Ratio of Gas Defects (%) |
|---|---|---|---|---|---|---|---|---|
| Com. Ex. 1 | 249 | 84 | 24 | 74 | 2.4 | 7 | 24 | 3.5 |
| Com. Ex. 2 | 204 | 93 | 24 | 74 | 2.5 | 9 | 23 | 4.8 |
| Com. Ex. 3 | 255 | 118 | 28 | 79 | 2.5 | 8 | 18 | 5.2 |
| Com. Ex. 4 | 200 | 100 | 27 | 79 | 2.5 | 8 | 17 | 2.7 |

TABLE 3-3-continued

Evaluation Results of Examples

| No. | Thermal Fatigue Life (cycles) at Constraint Ratio 0.25 | 0.5 | High-Temp. Yield Strength (MPa) at 1050° C. | High-Temp. Tensile Strength (MPa) at 1050° C. | Room-Temp. Elongation (%) at 25° C. | Weight Loss By Oxidation ($mg/cm^2$) at 1000° C. | 1050° C. | Area Ratio of Gas Defects (%) |
|---|---|---|---|---|---|---|---|---|
| Com. Ex. 5 | 219 | 79 | 24 | 75 | 2.5 | 8 | 27 | 0.8 |
| Com. Ex. 6 | 267 | 78 | 23 | 73 | 2.6 | 8 | 21 | 4.1 |
| Com. Ex. 7 | 198 | 73 | 21 | 70 | 1.9 | 9 | 19 | 3.5 |
| Com. Ex. 8 | 175 | 69 | 19 | 68 | 1.7 | 9 | 26 | 1.9 |
| Com. Ex. 9 | 198 | 96 | 45 | 107 | 1.8 | 7 | 22 | 1.3 |
| Com. Ex. 10 | 265 | 123 | 49 | 102 | 2.6 | 7 | 23 | 17.1 |
| Com. Ex. 11 | 274 | 138 | 75 | 128 | 1.7 | 8 | 20 | 15.6 |
| Com. Ex. 12 | 202 | 86 | 63 | 124 | 1.6 | 11 | 36 | 18.2 |
| Com. Ex. 13 | 172 | 51 | 31 | 92 | 1.2 | 13 | 45 | 21.8 |
| Com. Ex. 14 | 241 | 119 | 41 | 89 | 1.7 | 10 | 22 | 1.5 |

(2) High-Temperature Yield Strength and High-Temperature Tensile Strength

A flanged, smooth, round-rod test piece having a gauge length of 50 mm and a diameter of 10 mm cut out of each sample was mounted to the same hydraulic servo material tester as in the above thermal fatigue life test, to measure 0.2-% yield strength (MPa) and tensile strength (MPa) at 1050° C. in the air as the high-temperature yield strength and high-temperature tensile strength of each test piece. The results are shown in Table 3. As is clear from Table 3, the test pieces of Examples 1-47, in which the Al content was limited within the range of the present invention (0.23% or less), had higher high-temperature yield strength and high-temperature tensile strength than those of Comparative Examples 1-8, in which the Al content was more than 0.23%. Particularly when the Al content was 0.17% or less, the high-temperature yield strength was 40 MPa or more, indicating that the reduction of the Al content contributes to increase in the high-temperature strength.

Although the high-temperature yield strength was 50 MPa or more in Comparative Examples 11 and 12, they had short thermal fatigue lives with insufficient room-temperature elongation of less than 2.0%, indicating that they were not cast steel having excellent high-temperature yield strength, thermal fatigue life and room-temperature elongation. This appears to be due to the fact that too much O reduced the ductility by forming inclusions, cavities and gas defects, etc.

(3) Room-Temperature Elongation

A flanged, smooth, round-rod test piece having a gauge length of 50 mm and a diameter of 10 mm cut out of each sample was mounted to the same hydraulic-servo material tester as in the above thermal fatigue life test to measure room-temperature elongation (%) at 25° C. The results are shown in Table 3. While all Examples containing 0.01% or more of N had room-temperature elongation of 2.0% or more within the preferred range of the present invention, Comparative Examples 9 and 14 having a small amount of N had room-temperature elongation of 1.8% and 1.7%, respectively, insufficient for exhaust equipment members. Examples 3-47 containing 0.05% or more of N had room-temperature elongation of 2.8% or more within the more preferred range of the present invention, indicating that it is effective to contain N to improve the room-temperature elongation.

Although Comparative Examples 1-6 and 10 had room-temperature elongation of 2.0% or more, they had short thermal fatigue lives and insufficient high-temperature yield strength of less than 50 MPa, indicating that they were not excellent in both high-temperature yield strength and room-temperature elongation. This appears to be due to the facts that lots of inclusions and precipitates acting as the starting points of cracking and breakage were formed by too much Al in Comparative Examples 1-6, and that lots of nitrides, cavities and gas defects also acting as the starting points of cracking and breakage were formed by too much N in Comparative Example 10, resulting in the reduction of high-temperature yield strength and high-temperature tensile strength.

(4) Weight Loss by Oxidation

Expecting that exhaust equipment members are exposed to an exhaust gas at 1000° C. or higher, the oxidation resistance was evaluated at 1000° C. and 1050° C. The evaluation of the oxidation resistance was conducted by keeping a round-rod test piece having a diameter of 10 mm and a length of 20 mm cut out of each sample at each temperature of 1000° C. and 1050° C. for 200 hours in the air, subjecting the taken-out test piece to shot-blasting to remove oxide scales, and measuring the change of mass per a unit area before and after the oxidation test [weight loss by oxidation ($mg/cm^2$)]. The results are shown in Table 3.

As is clear from Table 3, Examples exhibited oxidation resistance at 1050° C. substantially on the same level as that of Comparative Example 14 using the heat-resistant cast steel described in JP2000-291430A, which was developed by the applicant of this application to improve oxidation resistance. It was thus confirmed from that the high-Cr, high-Ni, heat-resistant, austenitic cast steel of the present invention has sufficient oxidation resistance for exhaust equipment members exposed to an exhaust gas at 1000° C. or higher.

(5) Area Ratio of Gas Defects

To examine how easily gas defects were generated in the heat-resistant cast steel of Examples and Comparative Examples, test pieces in a flat plate shape permitting gas defects to be formed more easily than actual castings were produced. Accordingly, the measured area ratios of gas defects are extremely larger than those of actual castings. This flat-planar test piece 20 had a shape shown in FIG. 2(*a*), which had a width W of 50 mm, a length L of 185 mm, and a thickness T of 20 mm. Each flat-planar test piece 20 was obtained by pouring the same melt as for the one-inch Y-block at 1500° C. or higher into a sand mold having a cavity comprising a flat-planar test piece 20, a riser 21 having a diameter of 25 mm and a height of 50 mm, a sprue 22*a*, a runner 22*b*, and a gate 22*c*, through the sprue 22*a*, cooling the melt, and shaking-out the sand mold, cutting off the riser 21, and conducting shot-blasting.

Figure 2A:
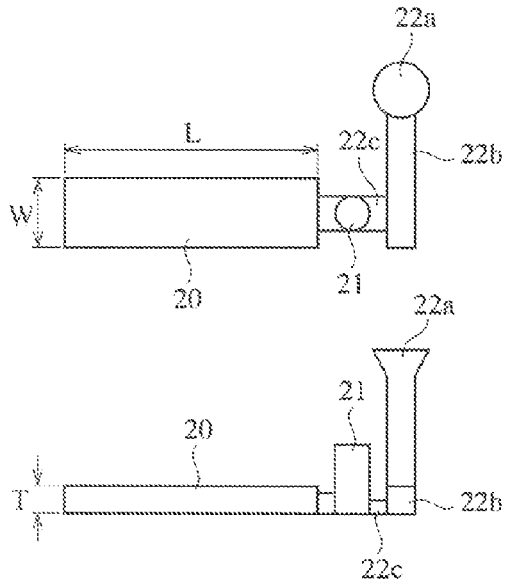
FIG. 2(*a*) is a schematic view showing a flat-planar test piece for measuring an area ratio of gas defects.
Figure 2B:
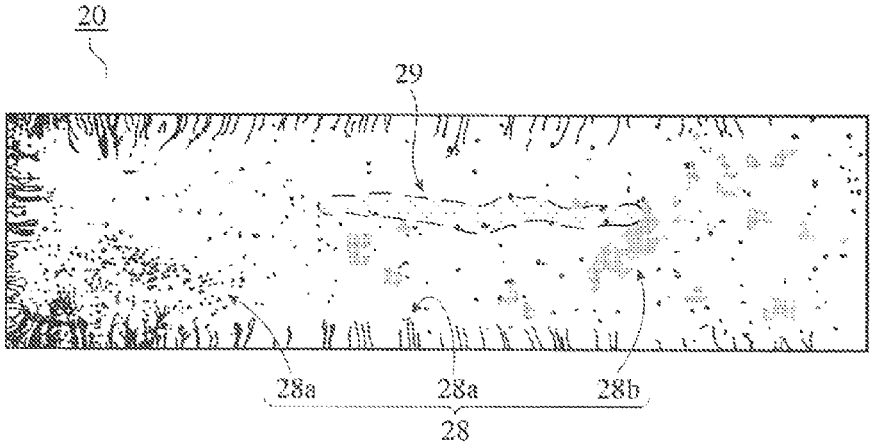

To observe gas defects on the surface of and inside the test piece, transmission X-ray photographs of each flat-planar test piece were taken by a transmission X-ray apparatus (EX-260 GH-3 available from Toshiba Corporation) at tube voltage of 192 kV for irradiation time of 3 minutes. FIG. 2(*b*) schematically shows one example of the transmission X-ray photographs. As shown in FIG. 2(*b*), the flat-planar test piece had gas defects 28 including pinholes 28*a* and blowholes 28*b*, and cavities 29. The gas defects and the cavities were easily discerned by contrast difference, etc. because the transmission X-ray photographs were clear. Indiscernible gas defects were observed by cutting the flat-planar test piece.

Gas defects on the surface of and inside the test piece observed by the naked eye were traced on each transmission X-ray photograph, and image-processed by an image analyzer ("IP1000" available from Asahi Kasei Corporation) to measure the total area ($mm^2$) of gas defects. The total area of gas defects was divided by the total projected area of the flat-planar test piece to obtain the area ratio (%) of gas defects. Of course, the smaller the area ratio of gas defects, the better the heat-resistant cast steel. The measurement results of the area ratio of gas defects are shown in Table 3.

As is clear from Table 3, the test pieces of Examples 1-47 containing N and/or O within the range of the present invention had smaller area ratios of gas defects than those of the test pieces of Comparative Examples 10-13 outside the range of the present invention. It was also found that as the amounts of N and/or O increased, the area ratio of gas defects tended to increase. The area ratio of gas defects was at maximum 12.8% in Examples, while it was 15% or more in Comparative Examples 10-13. Particularly in Comparative Example 13 containing too much N and O, the area ratio of gas defects was extremely as high as 21.8%. It was also appreciated that when (6O+N) exceeded 0.6%, the area ratio of gas defects drastically increased. It was thus confirmed that the generation of gas defects could be suppressed by regulating the upper limits of N, O and (6O+N).

Example 48

The cast steel of Example 36 was melted in a 100-kg, high-frequency melting furnace with a base lining in the air, poured into a ladle at 1550° C. or higher, and immediately poured into a sand mold for the turbine housing 32 shown in FIG. 3 at 1500° C. or higher. To reduce the weight, main portions of the turbine housing 32 were made as thin as 5.0 mm or less. The flanges, etc. of the turbine housing 32 were machined. Gas defects such as pinholes and blowholes, casting defects such as cavities and misrun, etc. were not observed in the resultant turbine housing 32, and machining trouble, the abnormal wear and breakage of cutting tools, etc. did not occur.

The turbine housing 32 of this Example was mounted to an exhaust simulator corresponding to a 2000-cc, straight, four-cylinder gasoline engine, to conduct a durability test for measuring cracks and a life until cracking occurred. The durability test conditions were such that the exhaust gas temperature at full throttle was 1100° C. at the inlet of the turbine housing 32, that the surface of the turbine housing 32 underwent the highest temperature of about 1050° C. and the lowest temperature of about 80° C. at the waist gate 32*b* (temperature amplitude=about 970° C.), and that one cycle comprised 10-minutes heating and 10-minutes cooling. The targeted number of heating/cooling cycles was 1500.

Figure 4:
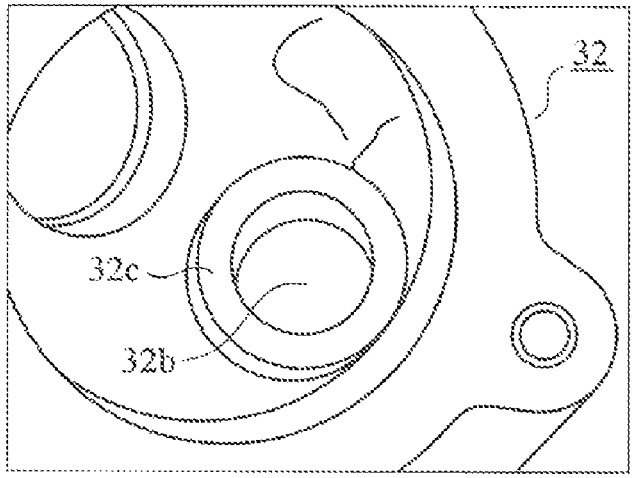
FIG. 4 is an enlarged view showing the turbine housing of Example near a waist gate after the durability test.

FIG. 4 shows the waist gate 32*b* of the turbine housing 32 after the durability test. This turbine housing 32 passed the durability test of 1500 cycles, without cracking in the waist gate 32*b*, through which a high-temperature exhaust gas passed as shown in FIG. 4. Little oxidation occurred not only in the waist gate 32*b* but also in other portions, without the leakage of the exhaust gas by thermal deformation.

The turbine housing 32 was subjected to usual mechanical vibration and shock at room temperature during the removal of risers and runners, finishing, conveying, cutting, assembling, etc., but no cracking and breakage occurred. It was thus confirmed that the turbine housing 32 made of the high-Cr, high-Ni, heat-resistant, austenitic cast steel of the present invention had practically sufficient ductility.

Comparative Example 15

Figure 5:
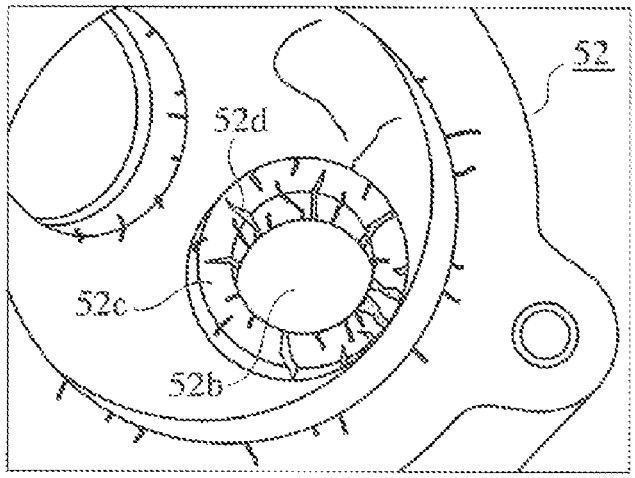
FIG. 5 is an enlarged view showing the turbine housing of Comparative Example near a waist gate after the durability test.

Using the cast steel of Comparative Example 5, a turbine housing 52 was produced with the same shape and under the same conditions as in Example 48, without casting defects and machining trouble. The resultant turbine housing 52 was mounted to the exhaust simulator to carry out the durability test with the target of 1500 cycles under the same conditions as in Example 48. However, the leakage of the exhaust gas occurred in the turbine housing 52 by 1000 cycles, so that the durability test was stopped. FIG. 5 shows the waist gate 52*b* of the turbine housing 52 after the durability test. As shown in FIG. 5, large cracks 52*d* were generated in the waist gate 52*b*, with a seat 52*c* deformed. Part of cracks 52*d* generated in the waist gate 52*b* penetrated to the outside, causing the leakage of the exhaust gas. Large numbers of cracks were also generated in other portions than the waist gate 52*b*. Compared with the turbine housing 32 of Example 48, more oxidation was observed in an inner wall of a scroll, which was a path of the exhaust gas.

As described above, the exhaust equipment members formed by the high-Cr, high-Ni, heat-resistant, austenitic cast steel of the present invention having excellent thermal fatigue life exhibited excellent durability when exposed to a high-temperature exhaust gas at 1000° C. or higher. The exhaust equipment member of the present invention is suitable for an automobile engine, because it can improve the initial performance of an exhaust-gas-cleaning catalyst when a thin exhaust equipment member is disposed on the rear side of an engine.

Although explanation has been made above on the exhaust equipment members for automobile engines, the present invention is not restricted thereto. The high-Cr, high-Ni, heat-resistant, austenitic cast steel of the present invention can also be used for cast parts required to have high heat resistance and durability such as high-temperature strength, oxidation resistance, ductility, thermal fatigue life, etc., for instance, in engines in construction machines, ships, aircrafts, etc.; heating equipment such as melting furnaces, heat treatment furnaces, incinerators, kilns, boilers, cogenerators, etc.; and various plants such as petrochemical plants, gas plants, thermal power-generating plants, nuclear power-generating plants, etc.

Effect of the Invention

The high-Cr, high-Ni, heat-resistant, austenitic cast steel of the present invention has high high-temperature yield strength, oxidation resistance and room-temperature elongation, with excellent thermal fatigue life particularly when exposed to a high-temperature exhaust gas at 1000° C. or higher. A thin exhaust equipment member made of such high-Cr, high-Ni, heat-resistant, austenitic cast steel has excellent durability when exposed to a high-temperature exhaust gas at 1000° C. or higher, thereby improving the initial performance of a exhaust-gas-cleaning catalyst when disposed on the rear side of an engine.

What is claimed is:

1. A high-Cr, high-Ni, heat-resistant, austenitic cast steel comprising as main components C, Si, Mn, Cr, Ni, W and/or Mo, and Nb, the balance being substantially Fe and inevitable impurities, N being 0.01-0.5%, Al being 0.008-0.23%, and O being 0.035-0.07% by weight, wherein Cr is 15-30%, Ni is 6-30%, Nb is 1.01-5% and (6O+N) is 0.6% or less by weight, and wherein it has a 0.2% yield strength of 50 MPa or more and a tensile strength of 105 MPa or more at 1050° C., and a room-temperature elongation of 2.0% or more.

2. A high-Cr, high-Ni, heat-resistant, austenitic cast steel comprising by weight 0.2-1.0% of C, 3% or less of Si, 2% or less of Mn, 0.5% or less of S, 15-30% of Cr, 6-30% of Ni, 0.5-6% (as W+2Mo) of W and/or Mo, 1.01-5% of Nb, 0.01-0.5% of N, 0.008-0.23% of Al, and 0.035-0.07% of 0, the balance being substantially Fe and inevitable impurities, wherein (6O+N) is 0.6% or less by weight, and wherein it has a 0.2% yield strength of 50 MPa or more and a tensile strength of 105 MPa or more at 1050° C., and a room-temperature elongation of 2.0% or more.

3. The high-Cr, high-Ni, heat-resistant, austenitic cast steel according to claim 1, wherein it comprises by weight 0.3-0.6% of C, 2% or less of Si, 0.5-2% of Mn, 0.05-0.3% of S, 18-27% of Cr, 8-25% of Ni, 1-4% (as W+2Mo) of W and/or Mo, 1.01-2.5% of Nb, 0.05-0.4% of N, 0.008-0.17% of Al, and 0.035-0.06% of 0, the balance being substantially Fe and inevitable impurities.

4. The high-Cr, high-Ni, heat-resistant, austenitic cast steel according to claim 1, wherein it has a thermal fatigue life of 500 cycles or more when measured by a thermal fatigue test comprising heating and cooling at the heating temperature upper limit of 1000° C., a temperature amplitude of 800° C. or more, and a constraint ratio of 0.25.

5. The high-Cr, high-Ni, heat-resistant, austenitic cast steel according to claim 1, wherein it has a thermal fatigue life of 300 cycles or more when measured by a thermal fatigue test comprising heating and cooling at the heating temperature upper limit of 1000° C., a temperature amplitude of 800° C. or more, and a constraint ratio of 0.5.

6. An exhaust equipment member made of the high-Cr, high-Ni, heat-resistant, austenitic cast steel recited in claim 1.

7. The exhaust equipment member according to claim 6, which is an exhaust manifold, a turbine housing, an exhaust manifold integral with a turbine housing, a catalyst case, an exhaust manifold integral with a catalyst case, or an exhaust outlet.

* * * * *